US006312123B1

(12) United States Patent
Codos et al.

(10) Patent No.: US 6,312,123 B1
(45) Date of Patent: Nov. 6, 2001

(54) METHOD AND APPARATUS FOR UV INK JET PRINTING ON FABRIC AND COMBINATION PRINTING AND QUILTING THEREBY

(75) Inventors: Richard N. Codos, Warren; William W. Collan, Freehold; Robert B. Comerford, Stewartsville, all of NJ (US); Angelo Quattrociocchi, Thornhill; Milan Badovinac, Mississouga, both of (CA)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/390,571

(22) Filed: Sep. 3, 1999

Related U.S. Application Data

(63) Continuation-in-part of application No. 09/070,948, filed on May 1, 1998, now Pat. No. 5,873,315.

(51) Int. Cl.[7] ..... B41J 2/01
(52) U.S. Cl. ..... 347/102; 347/101; 347/96
(58) Field of Search ..... 347/101, 102, 347/96, 212; 399/251, 341, 296

(56) References Cited

U.S. PATENT DOCUMENTS

| | | | | |
|---|---|---|---|---|
| 4,197,563 | * | 4/1980 | Michaud | 346/74.3 |
| 4,266,229 | | 5/1981 | Mansukhani . | |

(List continued on next page.)

FOREIGN PATENT DOCUMENTS

| | | | | |
|---|---|---|---|---|
| 0080448 | | 6/1983 | (EP) . | |
| 2322597 | * | 9/1998 | (GB) | B41M/7/00 |
| 2322597A | | 9/1998 | (GB) . | |
| 61-164836 | | 7/1986 | (JP) . | |
| 62092849 | * | 9/1987 | (JP) . | |
| 2-220883 | | 9/1990 | (JP) . | |
| 7-66530 | | 3/1995 | (JP) . | |
| 8-150707 | | 6/1996 | (JP) . | |
| 8-218018 | | 8/1996 | (JP) . | |
| WO 97/04964 | | 2/1997 | (WO) . | |
| WO 97/42034 | | 11/1997 | (WO) . | |
| WO 97/47481 | | 12/1997 | (WO) . | |

*Primary Examiner*—John Barlow
*Assistant Examiner*—M Shah
(74) *Attorney, Agent, or Firm*—Wood, Herron & Evans, L.L.P.

(57) ABSTRACT

Ink jet printing is provided onto fabric using ultraviolet (UV) light curable ink. The ink is first cured with UV light to about a 90–97% cure, and then is subjected to heating to more completely cure the ink and to remove by evaporation or otherwise, the uncured monomers and producing a printed image of ink having less than 100 PPM of uncured monomers, and as low as 10 PPM of uncured monomers. The printing is provided in a quilting machine having a quilting station and a printing station located upstream of the quilting station. Preferably, at the printing station, only a top layer of fabric is printed with a multicolored design under the control of a programmed controller. UV curable ink is jetted at a dot density of about 180×254 dots or more per inch per color, each dot of about 80 picoliters. A conveyor moves the printed fabric from the printing station through a UV curing station where a UV curing light head moves either with the print head or independent of the print head to expose the deposited drops of UV ink with a beam of about 300 watts per linear inch of energy, at a rate that applies about 1 joule per square centimeter. The conveyor then conveys the fabric through a heated drying station or oven where the fabric is heated to about 300° F. for from about 30 seconds up to about three minutes. Forced hot air is preferably used to apply the heat in the oven, but other heating methods such as infrared or other radiant heaters may be used. Before, or preferably after, the heat curing, the fabric is combined with other material layers and a quilted pattern is applied in program controlled coordination with the printed pattern.

29 Claims, 1 Drawing Sheet

U.S. PATENT DOCUMENTS

| | | | | |
|---|---|---|---|---|
| 4,271,347 | | 6/1981 | Svenson . | |
| 4,303,924 | | 12/1981 | Young, Jr. . | |
| 4,408,400 | | 10/1983 | Colapinto . | |
| 4,551,925 | | 11/1985 | Ericsson . | |
| 4,836,102 | | 6/1989 | Cicci . | |
| 4,971,408 | | 11/1990 | Hoisington et al. . | |
| 5,396,275 | * | 3/1995 | Koike et al. | 347/101 |
| 5,406,314 | | 4/1995 | Kuehnle . | |
| 5,409,504 | | 4/1995 | Fritzsche . | |
| 5,468,553 | | 11/1995 | Koike et al. . | |
| 5,500,023 | | 3/1996 | Koike et al. . | |
| 5,505,994 | * | 4/1996 | Crawford | 427/282 |
| 5,526,742 | | 6/1996 | Petersen . | |
| 5,537,137 | | 7/1996 | Held et al. . | |
| 5,563,644 | | 10/1996 | Isganitis et al. . | |
| 5,621,449 | | 4/1997 | Leenders et al. . | |
| 5,623,001 | | 4/1997 | Figov . | |
| 5,680,168 | | 10/1997 | Kokubo et al. . | |
| 5,690,028 | | 11/1997 | Schick . | |
| 5,699,100 | | 12/1997 | Fukuda et al. . | |
| 5,745,140 | | 4/1998 | Stoffel et al. . | |
| 5,748,204 | | 5/1998 | Harrison . | |
| 5,764,262 | | 6/1998 | Wu et al. . | |
| 5,774,155 | * | 6/1998 | Medin et al. | 347/102 |
| 5,858,514 | | 1/1999 | Bowers . | |
| 5,864,354 | | 1/1999 | Hibino . | |
| 5,873,315 | * | 2/1999 | Codos | 112/117 |
| 6,092,890 | * | 7/2000 | Wen et al. | 347/101 |

* cited by examiner

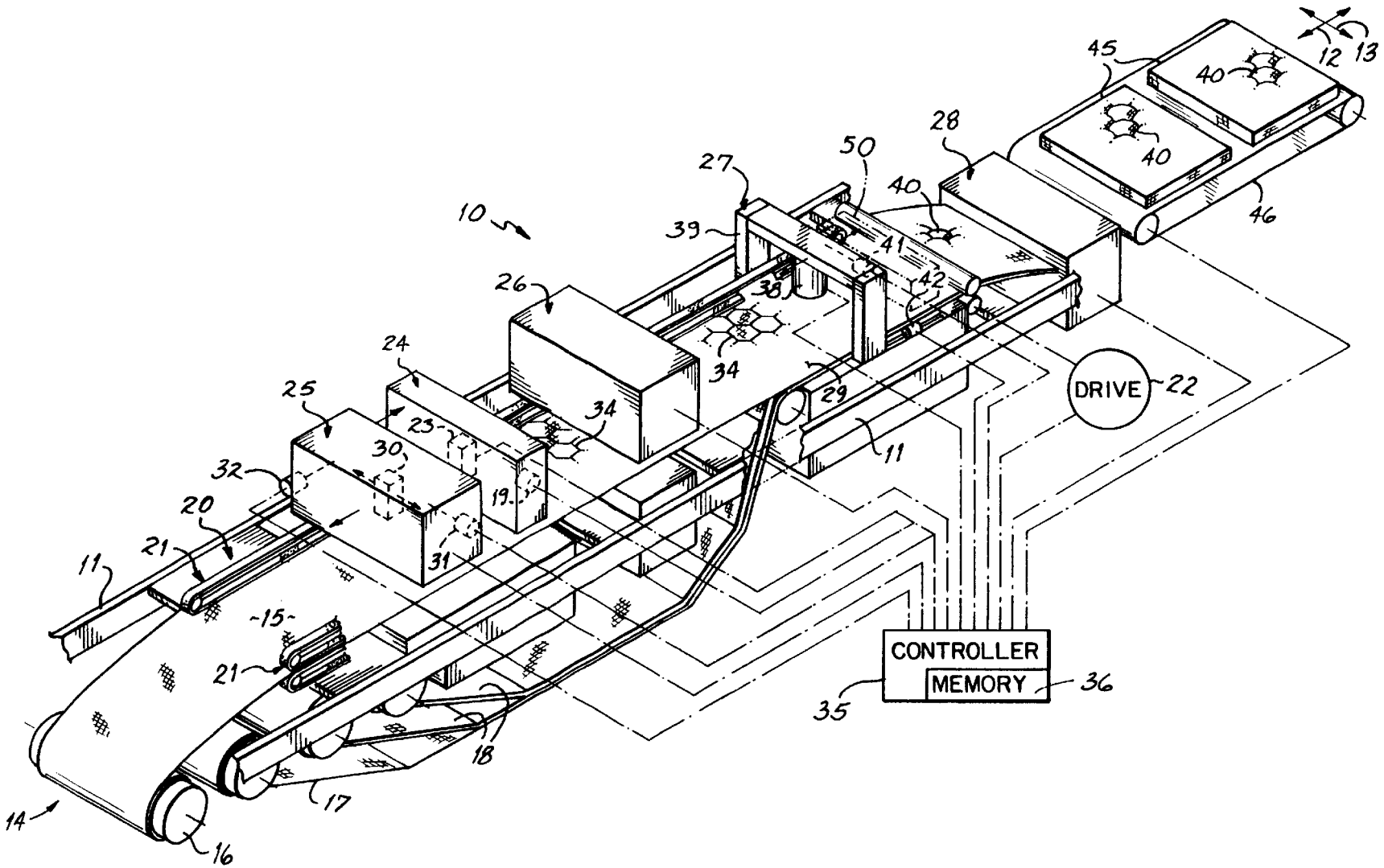
DRIVE
CONTROLLER
MEMORY

METHOD AND APPARATUS FOR UV INK JET PRINTING ON FABRIC AND COMBINATION PRINTING AND QUILTING THEREBY

This application is related to the commonly assigned and copending U.S. patent application Ser. No. 09/250,352, filed Feb. 16, 1999 entitled Combination Printing And Quilting Method And Apparatus, which is a continuation-in-part of the U.S. patent application Ser. No. 09/070,948, filed May 1, 1998, now U.S. Pat. No. 5,873,315, both of which are hereby expressly incorporated by reference herein.

FIELD OF THE INVENTION

The present invention relates to printing on fabric, and particularly to the printing of patterns onto fabric used in quilting such as onto multiple layer materials such as mattress covers, comforters, bedspreads and the like. The invention is more particularly related to the ink jet printing onto fabric, and to ink jet printing with ultra-violet light (UV) curable inks.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet that will have a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities.

Frequently, it is desirable to combine stitched patterns with printed patterns in mattress cover and other quilt manufacture. Application of the quilted pattern requires the application of ink to fabric, which, unlike paper, plastic or other smooth surfaces, presents a texture, or third dimension or depth, to the surface on which the printing is applied. A highly preferred method of applying ink to fabric is by jetting the ink onto the fabric by the process known as ink jet printing.

In ink jet printing, two categories of inks are used, solvent based inks and UV curable inks. Solvent based inks include either water or organic based solvents. Solvent based inks are cured by evaporation of the solvents. Some solvent based inks cure only by air drying, but many require the application of heat to enhance the evaporation of the solvent and, in some cases, to facilitate a chemical change or polymerization of the ink. UV curable inks include monomers that polymerize when exposed to UV light at a threshold energy level.

Heat or air curable inks that are organic solvent based or water based inks usually do not have the high color intensity that UV curable inks might have because the pigments or dyes that produce the color are somewhat diluted by the solvent. Furthermore, organic solvents can produce an occupational hazard, requiring that costly measures be taken to minimize contact of the evaporating solvents by workers and to minimize other risks such as the risks of fire. Solvent based inks also tend to dry out and eventually clog ink jet nozzles.

UV curable inks are capable of providing higher color intensity and do not present the hazards that many solvent based inks present. Printing with UV curable ink on fabric, however, presents other problems that have not been solved in the prior art. To cure UV ink, it must be possible to precisely focus a UV curing light onto the ink. UV ink, when jetted onto fabric, particularly onto highly textured fabric, is distributed at various depths over the texture of the fabric surface. Furthermore, the ink tends to soak into or wick into the fabric. As a result, the ink is present at various depths on the fabric, so that some of the ink at depths above or below the focal plane of the UV curing light evade the light needed to cause a total cure of the ink. In order to cure, UV ink must be exposed to UV light at an energy level above a curing threshold. However, increasing the intensity of the curing light beyond certain levels in order to enhance cure of the ink can have destructive effects on the fabric.

UV curing of jetted ink on fabric has a limited cure depth that is determined by the depth of field of the focused curing UV light. Therefore, the UV light proceeds to cure only about 90%, or 97%, and can be even up to about 99% of the ink when deposited on fabric. However, if more than an order of magnitude of approximately 100 parts per million (PPM) (0.01%) of the total volume of the jetted ink remains uncured, persons sensitive to the uncured monomers can suffer reactions. This is particularly unacceptable for fabrics such as mattress covers, as well as for clothing and many other fabrics.

Further, ink jet printing can be carried out with different ink color dots applied in a side-by-side pattern or in a dot-on-dot (or drop-on-drop) pattern. The dot-on-dot method is capable of producing a higher color density, but the higher density dot-on-dot pattern is even more difficult to cure when the cure is by UV light.

In addition, UV ink can be applied quickly to reduce wicking and UV ink can be developed to allow minimized wicking. Some wicking, however, helps to remove artifacts. Further, inks developed to eliminate wicking leave a stiff paintlike layer on the surface of the fabric, giving the fabric a stiff feel or "bad hand". Therefore, to reduce the UV curing problem by eliminating wicking is not desirable.

For the reasons stated above, UV curable inks have not been successfully used to print onto fabric. Heat curable inks can be cured on fabric. As a result, the ink jet printing of solvent based inks and heat curable or air dryable ink has been the primary process used to print on fabric. Accordingly, the advantages of UV curable ink jet printing have not been available for printing onto fabric.

There exists a need in printing of patterns onto mattress ticking and mattress cover quilts, as well as onto other types of fabrics, for a process to bring about an effective cure of UV curable inks and to render practical the printing with UV curable inks onto fabric.

SUMMARY OF THE INVENTION

An objective of the present invention is to provide for the printing of UV inks onto fabric, particularly highly textured fabrics such as, for example, quilts and mattress covers. A particular objective of the invention is to provide for the effective curing of UV inks jetted onto fabric by reducing uncured monomers to tolerable level, for example, to less than an order of magnitude of 1000 PPM, preferably to less than 100 PPM.

According to the principles of the present invention, UV ink is printed onto fabric and the cure of the ink is initiated by exposure to UV light. With or following the exposure to the UV light, the printed fabric is subjected to heat which extends the UV light initiated curing process. More particularly, UV curable ink is jetted onto a fabric, the jetted ink is exposed to UV curing light to cure the ink to about 90 to 97% polymerization, and then the fabric bearing the partially cured jetted ink is heated in a heat curing oven at which the UV light initiated polymerization continues, uncured monomers are vaporized, or both, in order to produce a printed image of UV ink that contains an order of magnitude of not more than 100 PPM of uncured monomer.

According to the preferred embodiment of the invention, UV ink is jetted onto a highly textured fabric such as a mattress cover ticking material, preferably prior to the quilting of the fabric into a mattress cover. The ink is jetted at a dot density of from about 180×254 dots per inch per color to about 300×300 dots per inch per color. Preferably, four colors of a CMYK color palette are applied, each in drops or dots of about 80 picoliters, or approximately 7 nanograms, per drop utilizing a UV ink jet print head. A UV curing light head is provided, which moves either with the print head or independent of the print head and exposes the deposited drops of UV ink with a beam of about 300 watts per linear inch, applying about 1 joule per square centemeter, thereby producing at least a 90% UV cure. The fabric on which the jetted ink has been thereby partially UV cured is then passed through an oven where it is heated to about 300° F. for from about 30 seconds up to about three minutes. Forced hot air is preferably used to apply the heat in the oven, but other heating methods such as infrared or other radiant heaters may be used.

The invention makes it possible to print images on fabric with UV curable ink by providing effective curing of the ink, leaving less than 100 PPM of uncured monomers, and usually leaving only about 10 PPM of uncured monomers. Thus, the invention provides the benefits of using UV curable ink over water and solvent based inks, including the advantages of high color saturation potential, low toxicity, without clogging of the jet nozzles.

These and other objects of the present invention will be more readily apparent from the following detailed description of the preferred embodiments of the invention.

BRIEF DESCRIPTION OF THE DRAWING

The FIGURE is a diagrammatic perspective view of a one embodiment of a web-fed mattress cover quilting machine embodying principles of the present invention.

DETAILED DESCRIPTION OF THE PREFERRED EMBODIMENT

The FIGURE illustrates a quilting machine 10 having a stationary frame 11 with a longitudinal extent represented by an arrow 12 and a transverse extent represented by an arrow 13. The machine 10 has a front end 14 into which is advanced a web 15 of ticking or facing material from a supply roll 16 rotatably mounted to the frame 11. A roll of backing material 17 and one or more rolls of filler material 18 are also supplied in web form on rolls also rotatably mounted to the frame 11. The webs are directed around a plurality of rollers (not shown) onto a conveyor or conveyor system 20, each at various points along the conveyor 20. The conveyor system 20 preferably includes a pair of opposed pin tentering belt sets 21 which extend through the machine 10 and onto which the outer layer 15 is fed at the front end 14 of the machine 10. The belt sets 21 retain the web 15 in a precisely known longitudinal position thereon as the belt sets 21 carry the web 15 through the longitudinal extent of the machine 10, preferably with an accuracy of 0 to ¼ inch. The longitudinal movement of the belt 20 is controlled by a conveyor drive 22. The conveyor 20 may take alternative forms including, but not limited to, opposed cog belt side securements, longitudinally moveable positive side clamps that engage and tension the material of the web 15 or other securing structure for holding the facing material web 15 fixed relative to the conveyor 20.

Along the conveyor 20 are provided three stations, including an ink jet printing station 25, a UV light curing station 24, a heated drying station 26, a quilting station 27 and a panel cutting station 28. The backing material 17 and filler material 18 are brought into contact with the top layer 15 between the drying station 26 and the quilting station 27 to form a multi-layered material 29 for quilting at the quilting station 27. Preferably, the layers 17,18 are not engaged by the belt sets 21 of the conveyor 20, but rather, are brought into contact with the bottom of the web 15 upstream of the quilting station 27 to extend beneath the web 15 through the quilting station 27 and between a pair of pinch rollers 44 at the downstream end of the quilting station 27. The rollers 44 operate in synchronism with the belt sets 21 and pull the webs 17,18 through the machine 10 with the web 15.

The printing station 25 includes one or more ink jet printing heads 30 that are transversely moveable across the frame 11 and may also be longitudinally moveable on the frame 11 under the power of a transverse drive 31 and an optional longitudinal drive 32. Alternatively, the head 30 may extend across the width of the web 15 and be configured to print an entire transverse line of points simultaneously onto the web 15.

The ink jet printing head 30 is configured to jet UV ink at 80 picoliters, or approximately 7 nanograms, per drop, and to do so for each of four colors according to a CMYK color pallette. The dots are preferably dispensed at a resolution of about 180 dots per inch by about 254 dots per inch. The resolution may be higher or lower as desired, but the 180×254 resolution is preferred. If desirable for finer images or greater color saturation, 300×300 dots per inch is preferable. The drops of the different colors can be side-by-side or dot-on-dot. Dot-on-dot (sometimes referred to as drop-on-drop) produces higher density.

The print head 30 is provided with controls that allow for the selective operation of the head 30 to selectively print two dimensional designs 34 of one or more colors onto the top layer web 15. The drive 22 for the conveyor 20, the drives 31,32 for the print head 30 and the operation of the print head 30 are program controlled to print patterns at known locations on the web 15 by a controller 35, which includes a memory 36 for storing programmed patterns, machine control programs and real time data regarding the nature and longitudinal and transverse location of printed designs on the web 15 and the relative longitudinal position of the web 15 in the machine 10.

The UV curing station 24 includes a UV light curing head 23 that may move with the print head 30 or, as is illustrated, move independently of the print head 30. The UV light curing head 23 is configured to sharply focus a narrow longitudinally extending beam of UV light onto the printed surface of the fabric. The head 23 is provided with a transverse drive 19 which is controlled to transversely scan the printed surface of the fabric to move the light beam across the fabric. Preferably, the head 23 is intelligently controlled by the controller 35 to selectively operate and quickly move across areas having no printing and to scan only the printed images with UV light at a rate sufficiently slow to UV cure the ink, thereby avoiding wasting time and UV energy scanning unprinted areas. If the head 23 is included in the printing station 25 and is coupled to move with the print head 30, UV curing light can be used in synchronism with the dispensing of the ink immediately following the dispensing of the ink.

The UV curing station 24, in the illustrated embodiment, is located immediately downstream of the printing station 25 so that the fabric, immediately following printing, is subjected to a UV light cure. In theory, one photon of UV light is required to cure one free radical of ink monomer so as to set the ink. In practice, one joule of UV light energy per square centimeter of printed surface area is supplied by the UV curing head 23. This is achieved by sweeping a UV beam across the printed area of the fabric at a power of 300 watts per linear inch of beam width. This is sufficient to produce a UV cure of at least 90%. Increasing the UV light power up to 600 watts per linear inch can be done to achieve a 97% or better cure. Alternatively, if fabric thickness and opacity are not too high, curing light can be projected from both sides of the fabric to enhance the curing of the UV ink. Using power much higher can result in the the burning or even combustion of the fabric, so UV power has an upper practical limit.

The heat curing or drying station 26 is fixed to the frame 11, preferably immediately downstream of the UV light curing station. With 97% UV cure, the ink will be sufficiently color-fast so as to permit the drying station to be off-line, or downstream of the quilting station 27. When on-line, the drying station should extend sufficiently along the length of fabric to adequately cure the printed ink at the rate that the fabric is printed. Heat cure at the oven or drying station 26 maintains the ink on the fabric at about 300° F. for up to three minutes. Heating of from 30 seconds to 3 minutes is the anticipated acceptable range. Heating by forced hot air is preferred, although other heat sources, such as infrared heaters, can be used as long as they adequately penetrate the fabric to the depth of the ink.

The exact percentage of tolerable uncured monomers varies from ink to ink and product to product. Generally, it is thought that uncured monomers of UV curable ink should be reduced to below an order of magnitude of 0.1%, or 1000 PPM, that is, to an order of magnitude of 100 PPM or less. In the preferred embodiment of the invention, uncured monomers of UV curable ink are reduced to less than 100 PPM, and preferably to about 100 PPM. As used herein, the percentage of portion of remaining uncured monomers refers to the mass of material that can be removed from a given sample of cured ink by immersing the cured ink sample in an aggressive solvent such as toluene, and measuring the amount of material in the solvent that is removed from the ink by the solvent. The measurements are made with a gas chromatograph with a mass detector. In the preferred embodiment of the invention, the measured amount of material removed from a given sample of the ink is less than 100 PPM by weight of the given cured ink sample. Measurements of 1000 PPM are undesirable. Measurements of 10 PPM are preferred.

The quilting station 27 is located downstream of the oven 26 in the preferred embodiment. Preferably, a single needle quilting station such as is described in U.S. patent application Ser. No. 08/831,060 to Jeff Kaetterhenry, et al. and entitled Web-fed Chain-stitch Single-needle Mattress Cover Quilter with Needle Deflection Compensation, which is expressly incorporated by reference herein, now U.S. Pat. No. 5,832,849. Other suitable single needle type quilting machines with which the present invention may be used are disclosed in U.S. patent applications Ser. Nos. 08/497,727 and 08/687,225, both entitled Quilting Method and Apparatus, expressly incorporated by reference herein, now U.S. Pat. Nos. 5,640,916 and 5,685,250, respectively. The quilting station 27 may also include a multi-needle quilting structure such as that disclosed in U.S. Pat. No. 5,154,130, also expressly incorporated by reference herein. In the figure, a single needle quilting head 38 is illustrated which is transversely moveable on a carriage 39 which is longitudinally moveable on the frame 11 so that the head 38 can stitch 360° patterns on the multi-layered material 29.

The controller 35 controls the relative position of the head 38 relative to the multi-layered material 29, which is maintained at a precisely known position by the operation of the drive 22 and conveyor 20 by the controller 35 and through the storage of positioning information in the memory 36 of the controller 35. In the quilting station 27, the quilting head 38 quilts a stitched pattern in registration with the printed pattern 34 to produce a combined or composite printed and quilted pattern 40 on the multi-layered web 29. This may be achieved, as in the illustrated embodiment by holding the assembled web 29 stationary in the quilting station 27 while the head 38 moves, on the frame 11, both transversely under the power of a transverse linear servo drive 41, and longitudinally under the power of a longitudinal servo drive 42, to stitch the 360° pattern by driving the servos 41,42 in relation to the known position of the pattern 34 by the controller 35 based on information in its memory 36. Alternatively, the needles of a single or multi-needle quilting head may be moved relative to the web 29 by moving the quilting head 38 only transversely relative to the frame 11 while moving the web 29 longitudinally relative to the quilting station 27, under the power of conveyor drive 22, which can be made to reversibly operate the conveyor 20 under the control of the controller 35.

In certain applications, the order of the printing and quilting stations 25,27, respectively, can be reversed, with the printing station 25 located downstream of the quilting station 27, for example the station 50 as illustrated by phantom lines in the figure. When at the station 50, the printing is registered with the quilting previously applied at the quilting station 27. In such an arrangement, the function of the curing station 26 would also be relocated to a point downstream of both the quilting station 27 and printing station 50 or be included in the printing station 50, as illustrated.

The cutoff station 28 is located downstream of the downstream end of the conveyor 20. The cutoff station 28 is also controlled by the controller 35 in synchronism with the quilting station 27 and the conveyor 20, and it may be controlled in a manner that will compensate for shrinkage of the multi-layered material web 29 during quilting at the quilting station 27, or in such other manner as described and illustrated in U.S. Pat. No. 5,544,599 entitled Program Controlled Quilter and Panel Cutter System with Automatic Shrinkage Compensation, hereby expressly incorporated by reference herein. Information regarding the shrinkage of the fabric during quilting, which is due to the gathering of material that results when thick, filled multi-layer material is quilted, can be taken into account by the controller 35 when quilting in registration with the printed pattern 34. The panel cutter 28 separates individual printed and quilted panels 45 from the web 38, each bearing a composite printed and quilted pattern 40. The cut panels 45 are removed from the output end of the machine by an outfeed conveyor 46, which also operates under the control of the controller 35.

The above description is representative of certain preferred embodiments of the invention. Those skilled in the art will appreciate that various changes and additions which may be made to the embodiments described above without departing from the principles of the present invention. Therefore, the following is claimed:

What is claimed is:

1. A quilting method comprising the steps of:

jetting UV curable ink onto a fabric to form a printed pattern on the fabric;

curing the ink on the fabric; and combining one or more secondary layers of material with the fabric; and quilting a quilted pattern on the combined layers of material and fabric over the pattern printed on the fabric.

2. The method of claim 1 wherein the curing step includes the steps of:

exposing the UV curable ink jetted onto the fabric to UV light to at least partially cure the ink on the fabric; and heating the fabric having the at least partially cured UV light cured ink thereon to reduce its content of uncured UV curable ink.

3. The method of claim 1 wherein the curing step includes the steps of:

exposing the UV curable ink jetted onto the fabric with a beam of about 300 watts per linear inch of UV light at a rate sufficient to apply about 1 joule per square centimeter of the ink; and heating the fabric having the at least partially cured UV light cured ink thereon to reduce uncured UV curable ink.

4. The method of claim 1 wherein the curing step includes the steps of:

exposing the UV curable ink jetted onto the fabric to UV light to at least partly cure the ink on the fabric; and heating the fabric having the at least partially cured UV light cured ink thereon to about 300° F. for at least about 30 seconds to reduce uncured UV curable ink.

5. The method of claim 1 wherein the curing step includes the steps of:

exposing the UV curable ink jetted onto the fabric with a beam of about 300 watts per linear inch of UV light at a rate sufficient to apply about 1 joule per square centimeter of the ink; and heating the fabric having the at least partially cured UV light cured ink thereon to about 300° F. for at least about 30 seconds to reduce uncured UV curable ink to less than 100 PPM.

6. A method of printing on fabric comprising the steps of:

jetting UV curable ink onto a fabric; then substantially curing the jetted ink on the fabric by exposing the UV curable ink to UV light, the curing resulting in substantially cured UV ink on the fabric containing uncured monomers of the UV curable ink; then heating the fabric having the substantially cured UV light cured ink thereon and thereby reducing the level of the uncured monomers of the UV curable ink on the fabric.

7. The method of claim 6 wherein the heating step includes the step of:

heating the fabric having the substantially cured UV light cured ink thereon and thereby reducing uncured monomers of the UV curable ink on the fabric to an order of magnitude of 100 PPM or less.

8. The method of claim 6 wherein the heating step includes the step of:

heating the fabric having the substantially cured UV light cured ink thereon and thereby reducing uncured monomers of the UV curable ink on the fabric to less than 100 PPM.

9. The method of claim 6 wherein the ink jetting step includes the step of jetting the UV curable ink at a dot density of at least about 180 dots per inch, each dot including about 80 picoliters of the ink.

10. The method of claim 6 wherein the curing step includes the step of:

exposing the UV curable ink jetted onto the fabric with a beam of about 300 watts per linear inch of UV light for a time that is sufficient to apply about 1 joule per square centimeter of the ink.

11. The method of claim 6 wherein the heating step includes the step of:

heating the fabric having the substantially cured UV light cured ink thereon to about 300° F. for at least about 30 seconds.

12. A fabric printing apparatus comprising:

a supply of UV curable ink;

an ink jet print head positioned to deposit dots of UV curable ink onto a fabric;

a UV light curing head positioned relative to the ink jet print head and configured to expose the ink deposited by the ink jet print head on the fabric to UV light of sufficient energy to substantially cure the ink; and a heating station positioned relative to the UV light curing head to heat the fabric having the exposed ink thereon with energy sufficient to substantially reduce the fraction of uncured monomers of the UV curable ink on the fabric; and means for conveying the fabric sequentially past the print and curing heads, then the heating station.

13. The apparatus of claim 12 wherein:

the UV light curing head is operative to expose the ink to UV light at an intensity sufficient to cure the UV curable ink deposited on the fabric to at least 90% cure; and the heating station is operative to heat the exposed ink to a temperature and for a time sufficient to reduce the portion of uncured UV curable ink on the fabric.

14. The apparatus of claim 12 wherein:

the UV light curing head is operative to expose the ink to UV light at an intensity sufficient to cure the UV curable ink deposited on the fabric to at least 90% cure.

15. The apparatus of claim 12 wherein:

the heating station is operative to heat the exposed ink to a temperature and for a time sufficient to reduce the portion of uncured UV curable ink on the fabric.

16. A quilting apparatus comprising the printing apparatus of claim 12 and further comprising:

a quilting station positioned to quilt a quilted pattern onto the fabric.

17. The apparatus of claim 12 wherein the ink jet print head is configured to dispense the UV curable ink onto the fabric at a dot density of at least about 180 dots per inch, each dot including about 80 picoliters of the ink.

18. The apparatus of claim 12 wherein the UV light curing head is configured to expose the UV curable ink on the fabric to a beam of about 300 watts per linear inch of UV light for a time sufficient to apply about 1 joule of UV light energy per square centimeter of the ink.

19. The apparatus of claim 12 wherein the heating station is configured to heat the at least partially cured UV light cured ink on the fabric to about 300° F. for at least about 30 seconds.

20. A method of printing onto a substrate comprising the steps of:

depositing polymerizable ink onto the substrate;

polymerizing the ink by initiating a polymerizing reaction in the ink and maintaining the reaction until the ink is substantially polymerized but contains at least some volatile unpolymerized monomers within an area of the substrate across which the ink is substantially polymerized; then drying the substantially polymerized ink to reduce its content of unpolymerized monomers across said area of the substrate.

21. The method of claim 20 wherein:

the depositing of the ink includes jetting ink onto the substrate.

22. The method of claim 20 wherein:

the depositing of the ink includes depositing UV curable ink onto the substrate; and the polymerizing of the ink on the substrate includes exposing the UV curable ink to UV light.

23. The method of claim 20 wherein:

the drying of the ink includes heating the substantially polymerized ink on the substrate and thereby reducing volatile ink components on the substrate.

24. The method of claim 23 wherein:

the drying includes flowing hot air onto the substrate having the substantially polymerized UV curable ink thereon.

25. The method of claim 20 wherein:

the depositing of the ink includes jetting UV curable ink onto the substrate;

the polymerizing of the jetted ink on the substrate includes exposing the UV curable ink on the substrate to UV light;

the drying of the ink includes heating the substantially polymerized UV light curable ink on the substrate and thereby reducing volatile UV curable ink components on the substrate.

26. The method of claim 25 wherein:

the drying includes flowing hot air onto the substrate having the substantially polymerized UV curable ink thereon.

27. The method of claim 25 wherein:

the drying includes flowing hot air onto the substrate having the substantially polymerized UV curable ink thereon to evaporate at least some of the unpolymerized monomers of ink from the substrate.

28. The method of claim 25 wherein:

the drying includes flowing hot air onto the substrate having the substantially polymerized UV curable ink thereon to further polymerize at least some of the unpolymerized monomers of ink from the substrate.

29. The method of claim 6 wherein:

the jetting of UV curable ink onto a fabric to form a printed pattern on the fabric includes jetting UV curable ink of a type that must be exposed to UV light at an energy level above a curing threshold before it will cure;

the substantially curing the jetted ink on the fabric includes exposing the UV curable ink to UV light at an energy level above the curing threshold; and the heating of the fabric having the substantially cured UV light cured ink thereon includes heating the fabric with thermal energy that includes energy other than UV light at the energy level above the curing threshold.

* * * * *

UNITED STATES PATENT AND TRADEMARK OFFICE

CERTIFICATE OF CORRECTION

PATENT NO. : 6,312,123 B1 
DATED : November 6, 2001
INVENTOR(S) : Codos et al.

It is certified that error appears in the above-identified patent and that said Letters Patent is hereby corrected as shown below:

Title page,
Item [63], Related U.S. Application Data, delete "Continuation-in-part of application No. 09/070,948, filed on May 1, 1998, now Pat. No. 5,873,315."

Signed and Sealed this

Seventh Day of January, 2003

JAMES E. ROGAN
*Director of the United States Patent and Trademark Office*